US010059489B2

(12) United States Patent
Mann

(10) Patent No.: US 10,059,489 B2
(45) Date of Patent: Aug. 28, 2018

(54) POP-UP CONTAINER USED FOR TEMPORARY STORAGE

(71) Applicant: Roy Neville Mann, Durban (ZA)

(72) Inventor: Roy Neville Mann, Durban (ZA)

( * ) Notice: Subject to any disclaimer, the term of this patent is extended or adjusted under 35 U.S.C. 154(b) by 0 days.

(21) Appl. No.: 15/031,525

(22) PCT Filed: Dec. 10, 2014

(86) PCT No.: PCT/ZA2014/000072

§ 371 (c)(1),
(2) Date: Apr. 22, 2016

(87) PCT Pub. No.: WO2015/113076

PCT Pub. Date: Jul. 30, 2015

(65) Prior Publication Data

US 2016/0257447 A1 Sep. 8, 2016

(30) Foreign Application Priority Data

Oct. 23, 2013 (ZA) ..... 2013/08832

(51) Int. Cl.

| | |
|---|---|
| ***B65D 25/00*** | (2006.01) |
| ***B65D 33/02*** | (2006.01) |
| ***G09F 1/06*** | (2006.01) |
| ***B65D 21/08*** | (2006.01) |
| ***B65D 25/28*** | (2006.01) |
| *A47F 5/13* | (2006.01) |
| *A47F 5/10* | (2006.01) |

(52) U.S. Cl.

CPC ..... *B65D 33/02* (2013.01); *B65D 21/086* (2013.01); *B65D 25/28* (2013.01); *G09F 1/065* (2013.01); *A47F 5/108* (2013.01); *A47F 5/13* (2013.01)

(58) Field of Classification Search

CPC ..... B65D 33/02; B65D 25/28; B65D 21/086; G09F 1/065; A47F 5/13

USPC ..... 220/9.1–9.4, 666, 667, 6, 7, 4.28, 4.08; 206/600, 170, 218; 383/12, 127, 104, 2; 248/97, 150, 153

See application file for complete search history.

(56) References Cited

U.S. PATENT DOCUMENTS 400,588 A 4/1889 Meyering et al.
6,315,143 B1 * 11/2001 Dotts ..... B65F 1/1415 220/6

(Continued)

FOREIGN PATENT DOCUMENTS

DE 202009014324 U1 12/2009
WO WO 03/101853 A1 12/2003

OTHER PUBLICATIONS

International Search Report and Written Opinion from International Patent Application No. PCT/ZA2014/000072 dated May 21, 2015.

*Primary Examiner* — Kareen Thomas
(74) *Attorney, Agent, or Firm* — Alston & Bird LLP

(57) ABSTRACT

A framework for a pop-up structure is provided comprising three or more loops (18, 12, 22) and a plurality of resilient deformable elongate members (14) extending between adjacent loops. The elongate members are pivotally attached to the loops (18, 12, 22) and the framework is extensible between a collapsed condition and a expanded condition, upon rotation of one loop relative to an adjacent loop. There is also provided a pop-up container comprising said framework and having an attachable cover.

15 Claims, 3 Drawing Sheets

(56) References Cited

U.S. PATENT DOCUMENTS

| | | | | |
|---|---|---|---|---|
| 6,830,170 | B2 * | 12/2004 | Abel | A01M 31/006 190/107 |
| 7,815,372 | B2 * | 10/2010 | Stanton | B65F 1/0006 220/9.3 |
| 2002/0036203 | A1 * | 3/2002 | Stewart | B65D 33/02 220/9.2 |
| 2005/0284866 | A1 * | 12/2005 | Oakner | B65F 1/02 220/9.2 |
| 2008/0056625 | A1 | 3/2008 | Stanton et al. | |
| 2009/0101641 | A1 * | 4/2009 | Fu | B65D 21/086 220/7 |
| 2012/0137554 | A1 * | 6/2012 | Puello | G09F 15/0012 40/607.1 |

* cited by examiner

POP-UP CONTAINER USED FOR TEMPORARY STORAGE

TECHNICAL FIELD OF THE INVENTION

This invention relates to pop-up container used for temporary storage.

BACKGROUND ART

Pre-assembled containers are known and are used for the temporary storage of various types of goods. These containers are easily transportable as they fold compactly and used only when needed.

These containers are compactable and are collapsed by the rotation thereof relative to their longitudinal axes. Amongst these containers are products which include spiral frames which are collapsible by rotation of the spiral, and then stored. These containers can only extend up to a low height and cannot maintain strength and stability at a greater height.

Furthermore, there are containers (NL8503540), which have frames including horizontal hoops which are interconnected by flexible profiled rods, and once extended the frames are covered in transparent flexible panels to form the container. The extension and collapsing of the frame of these containers occurs by rotation of the hoops relative to the longitudinal axis of the frame. The rods are connected to the hoops by hinge pins which assist in the collapsing of the frame of the container. These containers may only extend to a certain height and remain cumbersome in that there are numerous parts to be connected to form the container.

After storage and use of these types of containers, the containers often do not assemble effectively due to stress on the parts of the container frame.

The inventor believes that there is a need for a pop-up container which will alleviate some of the above mentioned problems, at least partially.

SUMMARY OF THE INVENTION

According to an aspect of the invention, there is provided a framework for a pop-up structure comprising three or more loops and a plurality of resiliently deformable elongate members extending between adjacent loops, the elongate members being pivotally attached to the loops, the framework being extensible between a first expanded condition and a second collapsed condition, upon rotation of one loop relative to an adjacent loop.

The elongate members may be attached to the loops by various attachment means, which pivot relative to the loops.

An attachment means may include a plug portion for receiving a first end of the elongate member and a further transverse aperture for receiving a loop there through. A further attachment means may include a plug portion for receiving a second end of the elongate member and a further aperture to receive an adjacent loop. The elongate members expand the framework to the first expanded condition.

The rotation of one loop relative to an adjacent loop causes the elongate members between the two loops to collapse vertically, and the framework to move to the second collapsed condition, the pivotal attachment means assisting in allowing the elongate members to collapse to a substantially parallel position relative to the loops.

Each loop may comprise a variety of shapes.

Each loop may be circular in shape and the framework forming a tubular structure in the first expanded condition.

The framework may be lightweight, yet will provide strength and remain flexible. The framework may be manufactured from any suitable material including fiberglass.

The framework may include a plurality of loops with interconnecting elongate members, the framework maintaining structural stability at varying heights.

The framework may include various support surfaces including shelves, which may assist in facilitating the graphic display of various goods.

According to a further aspect of the invention, there is provided a pop-up container comprising a framework having an attachable cover, the framework including three or more substantially parallel loops and a plurality of resiliently deformable elongate members extending between adjacent loops, the elongate members being pivotally attached to the loops, the framework of the container being extensible between a first expanded container condition and a second collapsed container condition, upon rotation of one loop of the framework relative to an adjacent loop.

Each loop may be circular in shape, and the container being tubular in shape in the first expanded condition.

The container may include an attachment means to secure the container into the second compact position.

The container may include a carrying means in the form of a handle or a bag.

BRIEF DESCRIPTION OF THE DRAWINGS

The invention will now be explained with reference to the following non-limiting drawings.

FIG. 1(*b*) shows an end loop pivoting member of an end or first loop;

FIG. 1(*c*) shows first and second pivoting members of an intermediate or second loop when the framework is in the second collapsed condition;

FIG. 1(*d*) shows the first and second pivoting members of the intermediate or second loop when the framework is in the first expanded condition;

DETAILED DESCRIPTION OF THE INVENTION

Figures 1A, 1B, 1C, 1D:
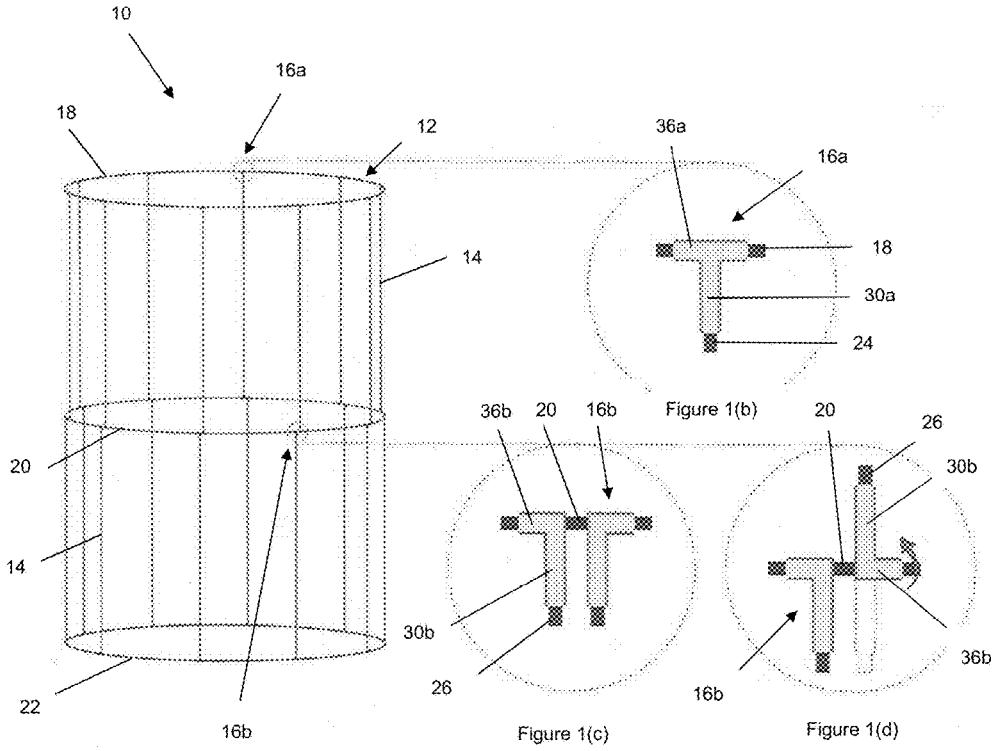
FIG. 1(*a*) shows a framework for a pop-up structure in the first expanded condition.

In the drawings, reference numeral 10 refers to a framework for a pop-up structure in accordance with the invention.

The framework 10 in accordance with the invention comprises at least three circular loops 12 of a container 10, a plurality of resiliently deformable elongate members 14 which are attached to the loops 12 by various pivoting members 16*a*, 16*b* (as shown in FIGS. 1 (*b*), (*c*) and (*d*)) which are pivotally associated with the loops 12, the pivoting members 16*a*, 16*b* are operable to pivot the elongate members 14 relative the loops 12 thereby allowing for collapsing of the framework 10 from a first expanded position to a second collapsed position, by rotation of the first loop 18 and/or the third loop 22 relative to the second loop 20.

The framework 10 is tubular in shape and the loops 12 and the elongate members 14 are made from lightweight and flexible material, specifically fiberglass, to maintain the strength of the structure. The tubular shape of the framework 10 is formed by the attachment of a suitable fabric to the loops 12 of the framework 10 during manufacture.

The elongate members 14 are connectable between the first loop 18 and the second loop 20, and furthermore, between the second loop 20 and the third loop 22. These elongate members 14 are also manufactured from a lightweight and flexible material which maintains strength of the pop-up framework 10 and container 10*a*.

FIG. 1*b* shows that the end loop pivoting member 16*a* which includes a plug portion 30*a* for receiving a first end 24 of the elongate member 14 and an aperture 36*a* for receiving the first loop 18 there through. FIGS. 1*c*, 1*d* show the first and second pivoting members 16*b* which each includes a plug portion 30*b* for receiving a second end 26 of the elongate member 16*b* and a further aperture 36*b* to receive the second loop 20. The elongate members 14 expand the framework 10 to the first expanded condition.

The rotation of one loop 18, 20, 22 relative to an adjacent loop 18, 20, 22 causes the elongate members 14 between the two loops 12 to collapse vertically, and the framework to move to the second collapsed condition. The rotation of the first and third loops 18, 22 cause the elongate members 14 between the loops 18, 20, 22 to collapse vertically, and the framework 10 to move to the second collapsed condition. The pivoting members 16*a*, 16*b* assist in allowing the elongate members 14 to collapse to a substantially parallel position relative to the loops 18, 20, 22.

FIG. 1(*d*) shows the first and second pivoting members 16*b* when the framework 10 is in the first expanded condition wherein the first and second pivoting members extend in opposing directions. FIG. 1(*c*) shows the first and second pivoting members 16*b* when the framework is in the second collapsed condition, wherein the first and second pivoting members 16*b* extend substantially parallel to each other.

Figure 2:
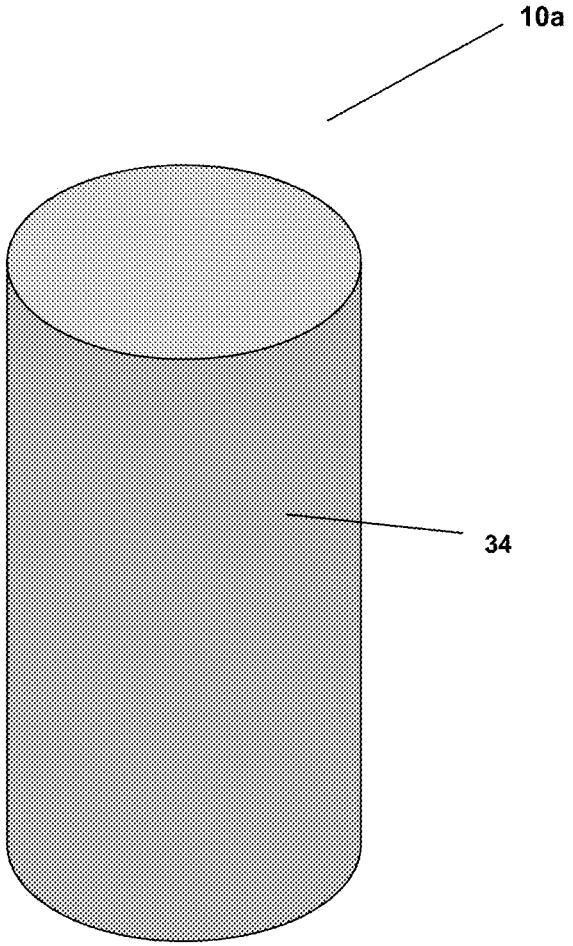
FIG. 2 shows a pop-up container in accordance with the invention.
Figure 3:
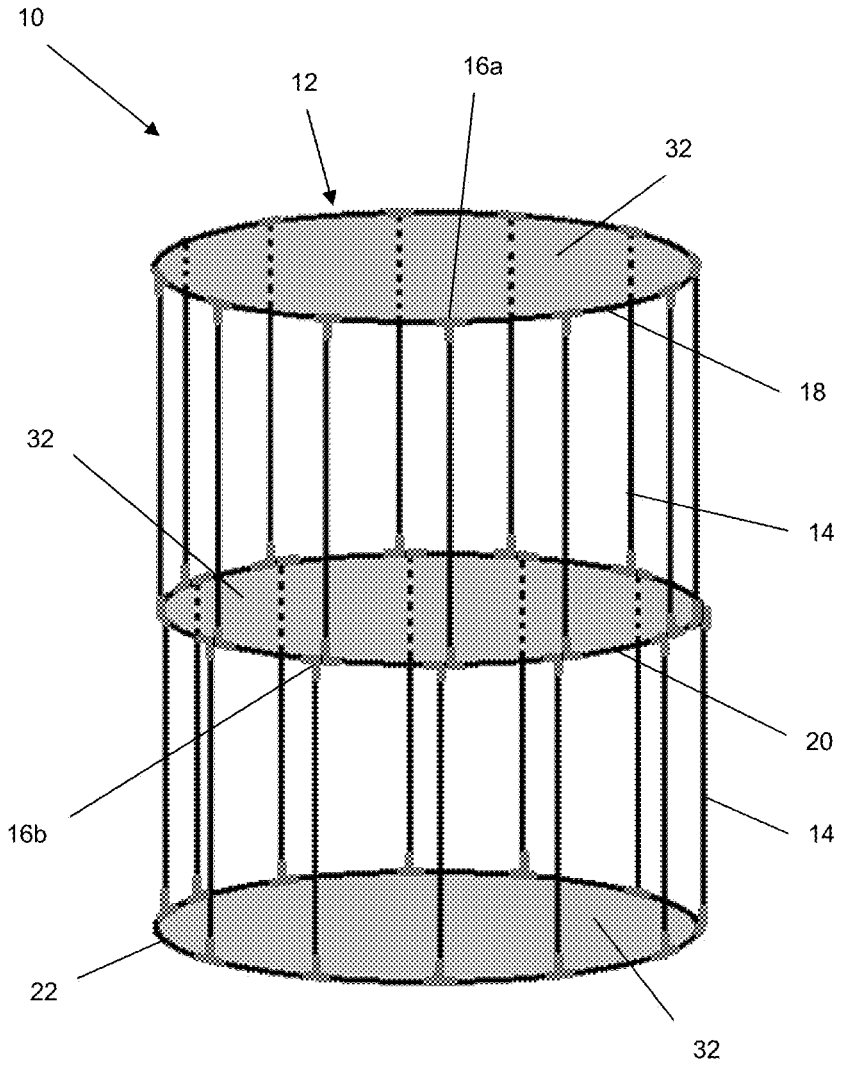
FIG. 3 shows the framework including various support surfaces.

As shown in FIG. 2, the framework 10 can be covered in a layer of suitable material 34 and form a pop-up container 10*a*. In a further embodiment of the invention, as shown in FIG. 3, the framework 10 includes various support surfaces 32 for the display of goods.

This invention relates to a novel framework for a pop-up structure and pop-up container for the temporary storage of goods or for use as a bin or for the display of goods.

The invention claimed is:

1. A framework for a pop-up structure comprising three or more loops and a plurality of resiliently deformable elongate members extending between adjacent loops, the elongate members being pivotally attached to the loops by various pivotal attachment means which pivot relative to the loops, wherein one or more intermediate loops are located between two end loops, and the one or more intermediate loops include a first pivoting member and a second pivoting member, the first pivoting member being attached to an end of an upper elongate member and the second pivoting member being attached to an end of a lower elongate member, an opposing end of the upper elongate member being connected to an adjacent upper loop and an opposing end of the lower elongate member being connected to an adjacent lower loop, wherein the first and second pivoting members are configured to pivot relative to each other and the intermediate loop such that the upper and lower elongate members are pivotal relative to each other and pivotal relative to the intermediate loop, and wherein the framework is extensible between a first expanded condition and a second collapsed condition, upon rotation of one loop relative to an another loop.

2. The framework for a pop-up structure as claimed in claim 1, characterized in that the pivotal attachment means includes an end loop pivoting member which is configured with a plug portion for receiving a first end of the elongate member and a further transverse aperture for receiving a loop there through.

3. The framework for a pop-up container as claimed in claim 1, characterized in that the first and second pivoting members include a plug portion for receiving a second end of the elongate member and a further aperture to receive an adjacent loop.

4. The framework for a pop-up container as claimed in claim 1, characterized in that the elongate members expand the framework to the first expanded condition.

5. The framework for a pop-up container as claimed in claim 1, characterized in that the rotation of one loop relative to an adjacent loop causes the elongate members between the two loops to collapse vertically, and the framework to move to the second collapsed condition, the pivotal attachment means assisting in allowing the elongate members to collapse to a substantially parallel position relative to the loops.

6. The framework for a pop-up container as claimed in claim 1, characterized in that each loop is circular in shape and the framework forming a tubular structure in the first expanded condition.

7. The framework for a pop-up container as claimed in claim 1, characterized in that the framework is lightweight, will provide strength and remain flexible and is manufactured from any suitable material.

8. The framework for a pop-up container as claimed in claim 7, characterized in that the framework is manufactured from fiberglass.

9. The framework for a pop-up container as claimed in claim 8, characterized in that the framework includes a plurality of loops with interconnecting elongate members, the framework maintaining structural stability at varying heights.

10. The framework for a pop-up container as claimed in claim 1, characterized in that the framework includes various support surfaces including shelves, which assist in facilitating the graphic display of various goods.

11. A pop-up container comprising the framework as claimed in claim 1, the container having an attachable cover.

12. The pop-up container as claimed in claim 11, characterized in that the container includes an attachment means to secure the container into the second collapsed condition.

13. The pop-up container as claimed in claim 11, characterized in that the container includes a carrying means in the form of a handle or a bag.

14. A framework for a pop-up structure comprising three or more loops and a plurality of resiliently deformable elongate members extending between adjacent loops, the elongate members being pivotally attached to the loops, the framework being extensible between a first expanded condition and a second collapsed condition, upon rotation of one loop relative to an adjacent loop, characterized in that the elongate members are attached to the loops by various attachment means, which pivot relative to the loops and characterized in that the pivotal attachment means includes an end loop pivoting member which is configured with a plug portion for receiving a first end of the elongate member and a further transverse aperture for receiving a loop there through.

15. A framework for a pop-up structure comprising three or more loops and a plurality of resiliently deformable elongate members extending between adjacent loops, the elongate members being pivotally attached to the loops, the framework being extensible between a first expanded condition and a second collapsed condition, upon rotation of one loop relative to an adjacent loop, characterized in that the elongate members are attached to the loops by various attachment means, which pivot relative to the loops and characterized in that the first and second pivoting members includes a plug portion for receiving a second end of the elongate member and a further aperture to receive an adjacent loop.

* * * * *